US006367374B1

(12) United States Patent
Van Den Bergh et al.

(10) Patent No.: US 6,367,374 B1
(45) Date of Patent: Apr. 9, 2002

(54) TREATMENT OF FOOD PRODUCTS

(75) Inventors: Herman P. Van Den Bergh, Enniskerry; Colm Moran, Dublin; Michael Broderick, Carlow, all of (IE)

(73) Assignee: Oseney Limited (IE)

( * ) Notice: Subject to any disclaimer, the term of this patent is extended or adjusted under 35 U.S.C. 154(b) by 0 days.

(21) Appl. No.: 09/600,642

(22) PCT Filed: Jan. 20, 1999

(86) PCT No.: PCT/IE99/00004

§ 371 Date: Dec. 5, 2000

§ 102(e) Date: Dec. 5, 2000

(87) PCT Pub. No.: WO99/36736

PCT Pub. Date: Jul. 22, 2000

(30) Foreign Application Priority Data

Jan. 20, 1998 (IE) ..... 980038

(51) Int. Cl.[7] ..... A23L 1/00; F25D 25/04; F25D 13/06

(52) U.S. Cl. ..... 99/443 C; 99/386; 99/477; 99/483; 198/463.1; 198/795

(58) Field of Search ..... 99/386, 443 R, 99/443 C, 477–479; 198/465.1, 795, 867.11, 867.14; 414/286; 62/382

(56) References Cited

U.S. PATENT DOCUMENTS 5,253,745 A * 10/1993 Van Den Bergh et al. ..... 198/465.1
5,320,210 A * 6/1994 Van Den Bergh et al. 99/443 C

FOREIGN PATENT DOCUMENTS

| | | | |
|---|---|---|---|
| EP | 0 474 514 | * | 3/1992 |
| FR | 1573761 | * | 7/1989 |
| GB | 105562 | * | 4/1918 |

* cited by examiner

*Primary Examiner*—Timothy F. Simone
(74) *Attorney, Agent, or Firm*—Rossi & Associates

(57) ABSTRACT

A product-carrying unit side portions extending along two opposite regions for engagement with respective support features of a product treatment chamber. A floor region of the unit extends between the side portions and consists of an array of floor region portions with together define a discontinuous upper product-carrying surface of the unit. The surfaces are suitably defined by the upper surfaces of the ribs of the unit. The spaces between the top surfaces of the ribs provide access to the underside of product supported on the discontinuous product supporting surface of the unit and enable heat exchange contact between the heat exchange medium and the underside of the product. The floor region of the unit is shaped to define ducts through which flow of heat exchange medium is directed for contact with the underside of the product supported on the unit.

9 Claims, 8 Drawing Sheets

TREATMENT OF FOOD PRODUCTS

BACKGROUND OF THE INVENTION

1. Field of the Invention

This invention relates to the treatment of products, in particular, foodstuffs or food products. The invention relates especially to product treatment systems, in particular systems for the treatment of foodstuffs or food products, in which product-carrying units supporting the product or products to be treated are accommodated within a product treatment chamber. The invention is especially directed to a product-carrying unit for use in a product treatment chamber to facilitate enhanced or accelerated freezing of packaged food products supported on the unit. The invention further encompasses product treatment systems and product treatment chambers comprising product-carrying units according to the invention for use in treatments such as freezing, chilling, rendering or humidification.

2. Description of the Prior Art

Product treatment chambers for the treatment of food products are well-known, as also are a variety of product-carrying units for supporting packaged foodstuffs undergoing treatment, in particular freezing, within such chambers. Numerous prior art systems provide chambers of significant transverse dimension within which the packaged foodstuffs are supported on product-carrying units, which may be referred to as planks or shelves, extending across the lateral dimension of the chamber. In one such construction; the floors or surfaces of these product-carrying units are supported on transverse members of channel or I-beam cross-section, which, in use of the units, extend across the chamber between slideways provided on the side walls of the chamber, the webs of the channels or I-beams being vertical and their lower flanges being carried on the slideways or support members of the side walls at the longitudinal ends of the transverse members. Where the transverse dimension of the chamber is substantial, these reinforcing cross members of the unit, underlying the shelf floor, are of significant cross-sectional dimensions and weight, to carry the substantial weight of the packaged foodstuffs supported on the shelf and to provide a structure which is self-supporting across the extended transverse width of the chamber. The shelf floor may be corrugated, to provide additional strength and minimise the likelihood of snap freezing, but the corrugated material forming the floor is typically substantially continuous and impermeable to the passage of air, either through the floor from above to below or vice versa, and also from front to rear through the corrugations.

Similar product-carrying units of lesser dimensions are also known, where the unit in use again spans the transverse dimension of the product treatment chamber between supporting rails or slideways disposed on the inner sides of side walls of the chamber. The provision of transverse I-beam or channel section cross members of significant dimensions and strength is avoided in these smaller supporting units by providing an internally stiffened or self-reinforcing structure, which is however of substantially solid construction, being substantially impermeable to the passage of air in the direction of any of its dimensions, whether front to rear, transverse width, or depth. In use of both of the foregoing two known constructions of shelf, the shelves are loaded into the product treatment chamber or store in edge to edge abutting manner, so that a continuous sequence of abutting shelves is provided on each tier or level of the product treatment chamber or store. The close abutment in substantially edge to edge manner of these juxtaposed shelves on each tier of the storage chamber substantially prevents movement of air from tier to tier within the store, at any location other than the store ends. Thus, in carrying on a product treatment operation in a store or chamber accommodating units of the kind indicated in the foregoing paragraphs, there is substantial stratification of air movement, so that air entering the chamber at one end for the purposes of, for example, cooling or freezing food product accommodated on the shelves, is constrained to pass to the other end of the store substantially at the level or tier at which it enters, there being no significant possibility of air movement through the shelves to a level or tier above or below the particular airflow passage defined between a particular sequence of shelves and the sequence above or below it.

A further construction of product accommodating unit is also known, in which a multiplicity of shelves is provided within a single unit, referred to as a so-called "bookcase". The bookcase unit may have typically nine shelves disposed one over the other and the entire bookcase is moved through the storage treatment chamber or store, within which it is supported on lateral slideways or support rails. Again bookcase units are moved through a treatment chamber or store from end to end by bringing them into abutting or juxtaposed contact in which each level or tier of shelves again defines a substantially self-contained airflow region for air movement from end to end within the store, without any significant possibility of transfer of air to other levels within the chamber during a treatment operation.

This absence of the possibility of circulation of air to different levels within the store constrains to a certain degree the efficiency with which heat exchange may be effected within the chamber, whether for freezing or for any other heat exchange purpose. In a product treatment chamber of the type within which product-carrying units of the kind recited above are accommodated, cold air is driven through the store to typically chill or freeze food product accommodated on the shelves. The greater the degree of contact which can be effected between the cooling heat exchange medium or air and the food product, which is typically packaged, the more effective the product treatment. Precisely the same applies in the case of a heat treatment operation or any other similar process step. The efficiency of heat exchange is limited in stores of the kind recited above due to the relative stratification of airflow so that the air passes through particular tiers or levels of the loaded storage chamber as separate streams of heat exchange medium and also due to the inability of the cooling air to come in contact with the underside of the product to be treated, in the case of the product being accommodated on a substantially solid or air-impermeable shelf. Depending on the type of product-carrying unit used, airflow within a particular tier or level may also be substantially laminar, with little turbulence being present, so that the efficiency of heat exchange may also be constrained for this reason.

EP-B1-0,474,514 of the present Applicants provides a product treatment chamber and storage system, as well as a product-carrying unit for accommodation in the chamber or storage system, in which the product-carrying units have edge regions extending along two opposite sides for travelling engagement with respective guide and support rails defining guide means for travelling movement of the unit. This European Patent describes an arrangement for coupling the product-carrying units together, in particular in a chamber structure in which parallel pairs of guide rails are provided on the internal side walls of the chamber. Irish Patent Specification No. 78447, also of the present Applicants, provides a variant of this product-carrying unit in which the floor of the pallet is apertured or perforated, or formed from a mesh material. Finely apertured or mesh materials are however undesirable in certain applications for reasons of hygiene and ease of cleaning.

BRIEF SUMMARY OF THE INVENTION

It is an object of the present invention to provide improvements in facilitating accelerated, enhanced or expedited treatment of foodstuffs supported on a product-carrying unit in a product treatment chamber of the kind discussed above, in particular for the freezing of such products. It is a particular object of the invention to provide an improved product-carrying unit of the kind described by EP-81-0,474,514, but the invention is not limited to such units and may also be applied to the known shelf structures and chambers of the prior art. It is a further objective of the invention to provide for improved heat exchange with product supported on such units in a construction which is compatible with the hygiene and cleaning requirements of product treatment systems for foodstuffs in particular.

According to the invention in a first aspect, there is provided a product-carrying unit for use in a product treatment chamber, the unit having:

side portions extending along two opposite side regions of the unit for engagement with respective support features of a product treatment chamber, and a floor region for the support of product, said floor region extending between said side portions and comprising a multiplicity of floor region portions together defining a discontinuous upper product-supporting surface of the unit, wherein spaces defined between at least some of said multiplicity of floor region portions provide access to an underside region of product disposed on said discontinuous upper product-supporting surface of the unit for heat exchange contact between a heat exchange medium and said underside region, characterised in that said floor region is shaped to define means for directing flow of heat exchange medium towards said spaces for said heat exchange contact between a heat exchange medium and said underside region.

Said floor region may be shaped to define duct regions for the passage of a heat exchange medium substantially between a region in the vicinity of one edge portion of the unit extending between said side portions of the unit and a region in the vicinity of another edge portion of the unit also extending between said side portions, said spaces or vents communicating between said duct regions and said upper product-supporting surface of the unit. Access to said duct regions for at least ingress of heat exchange medium is preferably provided on the lower side of the unit intermediate said edge portions of the unit.

In a favoured embodiment, said floor region comprises a multiplicity of rib members extending between said edge portions in a direction substantially parallel to said side portions, upper surface regions of said rib members defining said discontinuous upper product-supporting surface of the unit, said duct regions being defined between said rib members.

The invention thus suitably provides a structure of significant strength capable of carrying in particular cased food products to be frozen, with the unit supported only at its ends or side edges, so that there is a clear unobstructed space across the width of the treatment chamber within which the unit is located for the turbulent flow of chilled air, together with passage of the cooling medium through ducts defined between ribs, for chilling contact with the undersides of the cases, thereby engendering especially effective and speedy chilling action.

In an especially preferred construction, said rib members slope downwardly from one of said edge portions of the unit towards the other of said edge portions of the unit. A stop feature for restraint of product supported on the unit may provided at said other of the edge portions of the unit. Suitably, said rib members terminate at said one of the edge portions of the unit at a level above that of the upper edge of a cross-member defining said one of the edge portions, and the upper surfaces of said rib members are sloped downwardly in the vicinity of said one of the edge portions to define a ramp portion extending from said upper edge of said cross-member to the level of said discontinuous upper product-supporting surface of the unit, i.e. between said upper edge and said product-carrying surface. In a preferred embodiment, said rib members are substantially frustoconical in cross-section in the direction extending between said edge portions of the unit.

In a particularly favoured construction, said rib members are defined by upstanding folded regions of an initially planar material portion and the rib members are substantially uniformly spaced from one another by remaining intervening planar sections of said initially planar material. Access to said duct regions for at least ingress of heat exchange medium is then suitably provided by apertures or vents in said remaining intervening planar sections of said initially planar material.

The unit according to the invention may further comprise means provided on at least one edge portion of the unit extending between said side portions of the unit for spacing the unit from a like unit engaged on the same support features of a product treatment chamber to provide a space between said unit and said like unit for the passage of heat exchange medium through said space between said unit and said like unit between an air flow region within the chamber above said unit and said like unit and an air flow region within the chamber below said unit and said like unit.

In a second aspect, the invention may then provide a product-carrying unit for use in a product treatment chamber, the unit having:

side portions extending along two opposite side regions of the unit for engagement with respective support features of a product treatment chamber, and a floor region for the support of product, characterised in that means are provided on at least one edge portion of the unit extending between said side portions of the unit for spacing the unit from a like unit engaged on the same support features of a product treatment chamber to provide a space between said unit and said like unit for the passage of heat exchange medium through said space between said unit and said like unit between an air flow region within the chamber above said unit and said like unit and an air flow region within the chamber below said unit and said like unit.

Said spacing means is suitably provided on each edge portion of the unit extending between said side portions of the unit and may be defined by means for coupling said unit to said like unit.

The unit according to the invention is especially suited to an embodiment in which said side portions provide for travelling engagement with said support features, and said support features comprise guide and support rails disposed on opposite internal side walls of a product treatment chamber, but the invention may also be applied in chambers in which alternative support arrangements prevail.

BRIEF DESCRIPTION OF THE DRAWINGS

The invention will now be described in detail having regard to the accompanying drawings, in which.

DETAILED DESCRIPTION OF THE DRAWINGS

Figure 1:
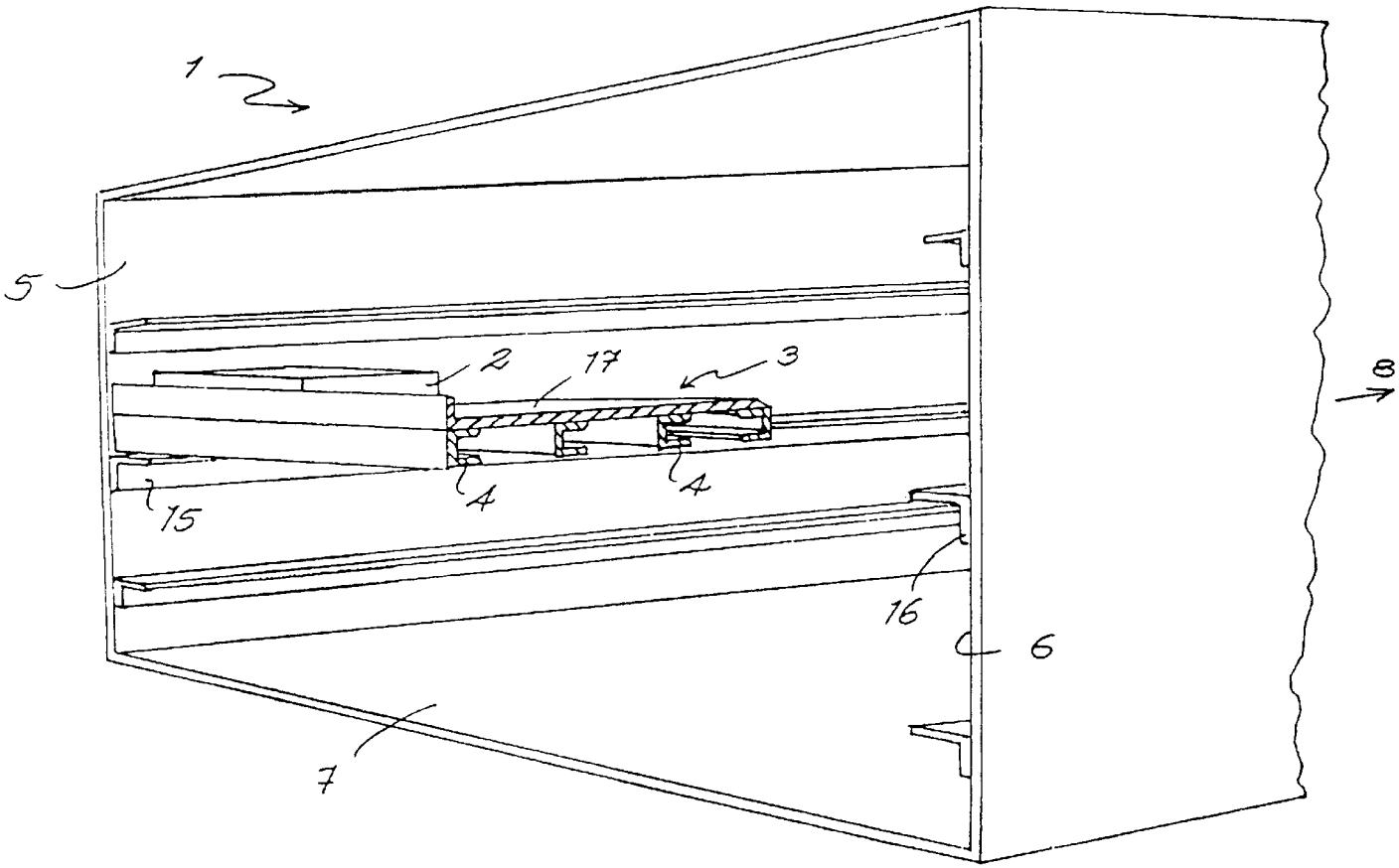
FIG. 1 shows a schematic pictorial view of one arrangement of known store or product treatment chamber.

FIG. 1 shows a diagrammatic pictorial representation of a store or product treatment chamber 1 for freezing packaged food products. As shown in the drawing, packaged food product 2 is supported on substantially rectangular product-carrying units 3, one of which is shown part cutaway, which units 3 have transverse reinforcing members 4 underlying the floor 17 of the unit 3 and extending across the width of the store 1 between carrying rails or slideways 15, 16 provided on inner side walls 5, 6 of the chamber 1. The transverse reinforcing members 4 are suitably of channel cross-section, with the web vertical. Product-carrying units 3 may be pushed in at one end 7 of the store 1 and driven successively forward by the loading of subsequent further units 3 at the same end 7 on the same level, i.e. onto the same slideways to be displaceably supported thereon, until frozen product emerges by being pushed out-at the exit end 8 of the store 1. Stores 1 of this kind are typically of substantial transverse dimension and the channel or I-beam cross-section reinforcing members 4 for the product-carrying units 3 or planks are typically of comparably significant dimensions, the longitudinally opposite ends of the members 4 being supported on the upper sides of the slideways or carrying rails 15, 16. The floors 17 of such product-carrying units are also typically solid or impermeable to the passage of air or other fluids, although they may be formed of folded or corrugated sheet material, without however features enabling the passage of cooling air through the floor in the direction of any of its dimensions.

Stores or treatment chambers of the same general kind are also provided in accordance with EP-B1-0,474,514 of the present Applicants, but with an alternative supporting arrangement, in which edge regions of the product-carrying units extending along two opposite sides are adapted for travelling engagement such as by rollers with respective guide and support rails defining guide means for travelling movement of the unit. These guide and support rails are provided on the inner sides of the side walls of the chamber. No other support is provided for the underside of the product-carrying unit within the chamber. The above-mentioned European Patent describes coupling arrangements for linking together product-carrying units of this kind for forward or reverse travelling movement through the store, either by being pushed forward or by being pulled rearwardly. Thus product-carrying units of this kind may be loaded into the store at either end and may likewise be withdrawn from the store at either end.

Figure 2:
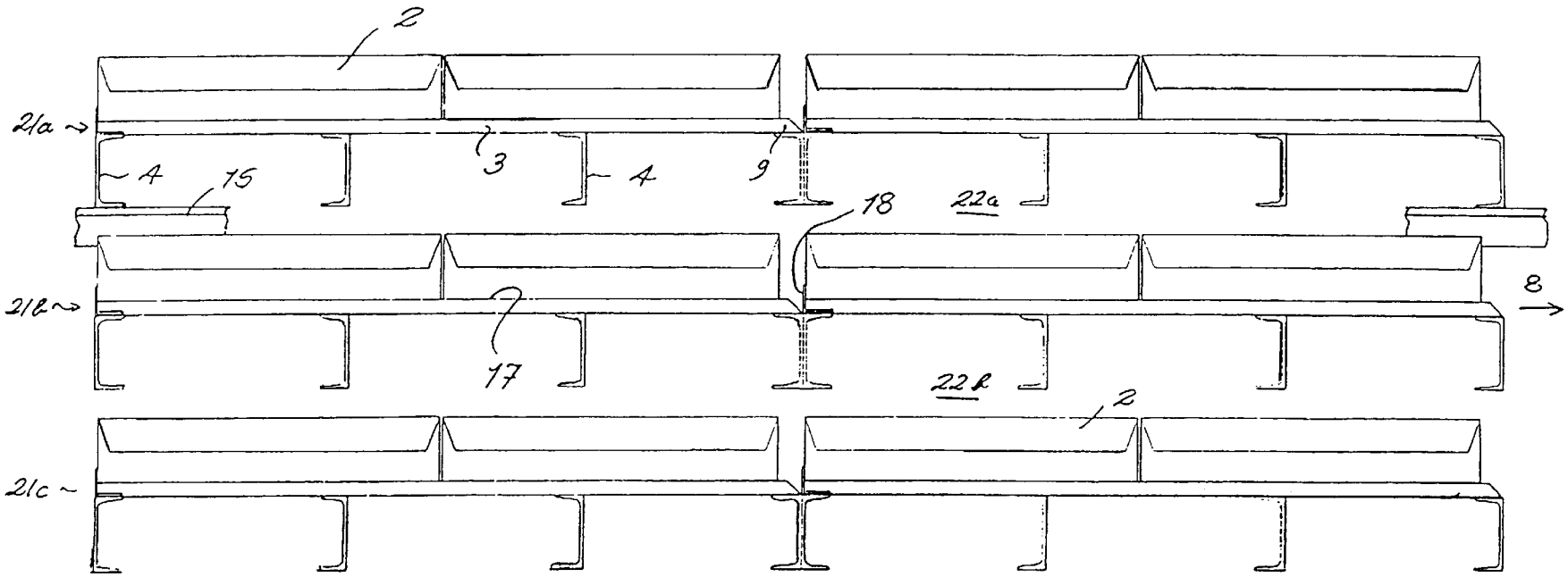
FIG. 2 shows in diagrammatic form, the prior art arrangement of the kind illustrated in FIG. 1, for a multiple case layout, with stacked tiers of shelves and a plurality of product-carrying units or shelves on each level or tier in juxtaposed edge-to-edge disposition.

FIG. 2 illustrates a multiple layered store according to FIG. 1, in side view in section, three layers 21*a*, 21*b*, 21*c* being shown, but further layers or tiers also being possible at higher or lower levels within the store 1, i.e. each layer or tier consisting of a sequence of units 3 carried by and supported on the same pair of slideways on the side walls.

The planks or shelves 3 can be seen to each have a substantially solid or air-impermeable floor 17, underlaid by the transverse reinforcing beams 4 of channel cross-section, the ends of which travel on the guide rails or support arrangements 15, 16 on the inner sides of the side walls of the store or chamber. Food product 2 to be frozen is supported on the solid floor 17 of the shelf 3. An upstanding angle section 18 at the rear of the shelf 3 prevents packaged food product from being displaced off the shelf 3, during forward displacement of the shelf 3 through the store 1. As will be seen in FIG. 2, on each level of the store, a sequence of shelves 3 is effectively butted together, with a ramped leading side edge 9 of each shelf in engagement with the upwardly flanged trailing side edge 18 of the shelf ahead of it in the sequence, so as to define a substantially continuous floor from one end of the store 1 to the other. There is thus established within the store, tiers or levels of air passages 22*a*, 22*b*, each of which is substantially closed off from the levels above or below for the passage of air. Thus air conducted through the store 1 for freezing the food product, once it enters into a space 22*a* or 22*b* between two particular tiers or levels of shelves 21*a* and 21*b*, or 21*b* and 21*c*, can only pass through that space 22*a* or 22*b* to reach the exit end 8 of the store 1. There is thus substantial stratification of airflow within the store. Furthermore, the substantially solid shelf floors 17 prevent air from reaching the undersides of the cases 2 supported on the shelves 3.

Figure 3:
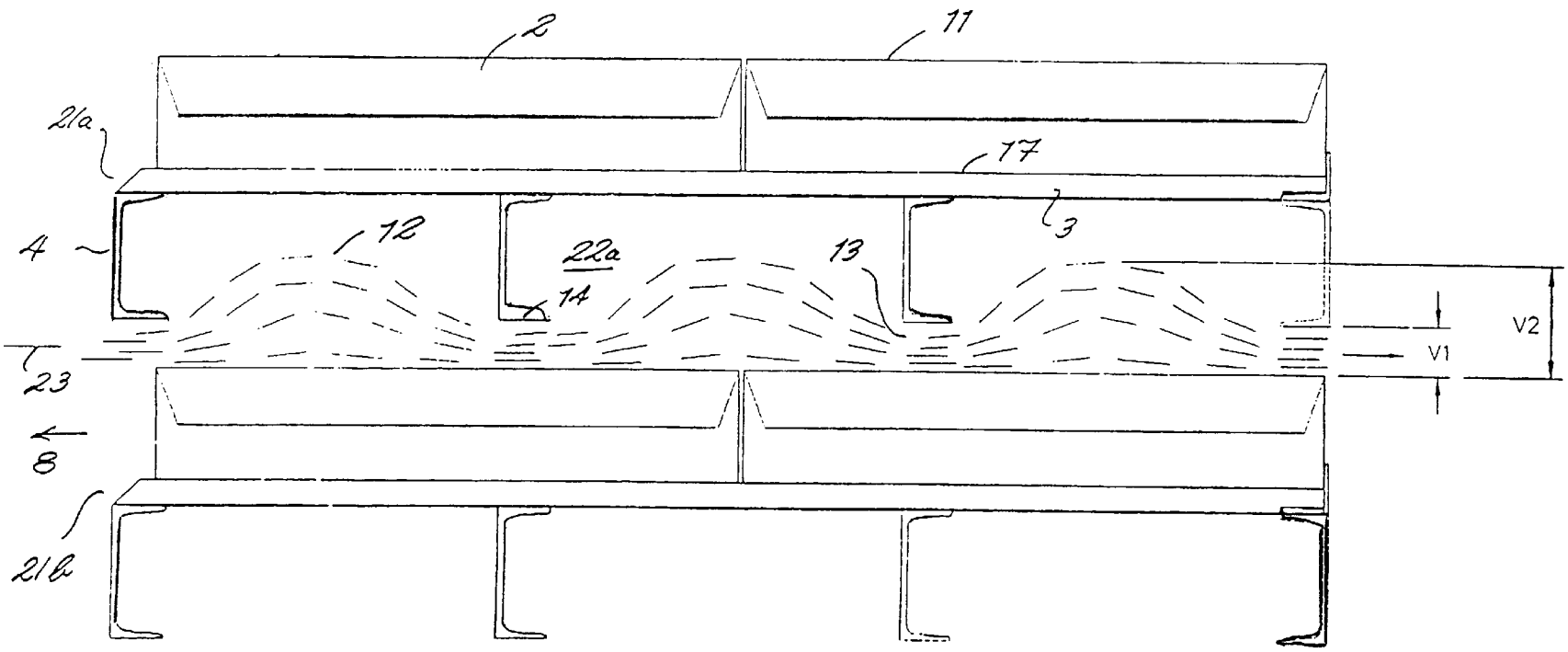
FIG. 3 shows in enlarged diagrammatic detail, airflow conditions in the prior art store of FIGS. 1 and 2, in which the product-supporting units comprise substantial transverse members of channel section.

FIG. 3 is an enlarged cross-sectional view of a portion of this first type of prior art store discussed above, FIGS. 1 and 2, showing the airflow that prevails in the space 22*a* between two levels or tiers of loaded product-support units 3, during a freezing operation. Certain significant disadvantages arise in regard to the speed and effectiveness of freezing, with this configuration of chamber 1. The ideal scenario in freezing a cased food product is that the entirety of the cased surface should be exposed to the chilled airflow. This is obviously not wholly feasible, to the extent that the underside of the case surface must necessarily be supported by some carrying structure. Thus as shown in FIG. 3, the majority of the heat exchange from the case 2 to the airflow 23 will take place over the upper surface 11 of the case or package 2, but since typically the food product will subside somewhat within the case 2 away from the top surface 11, this arrangement is relatively ineffective, because an air gap then prevails within the case 2 between the upper surface of the food product within the case 2 and the underside or inside of the top or lid or cover 11 of the case 2 itself.

Thus, in the situation shown in FIG. 3, not only is the package surface area exposed to airflow only a little more than one-half of the total surface of the case 2, but the actual foodstuff to be frozen within the case is not necessarily in internal contact with the top surface 11 of the case. As will be apparent from FIG. 3, the air impingement effect does not operate on the underside of the case 2 on account of the product-carrying units 3 being solid and air-impermeable. It will also be apparent that stagnation zones 12 exist between the supporting or reinforcing cross members 4 of the shelves 3, with the air velocity V2 within these stagnation regions 12 being as little as one-half of the speed V of airflow through the gaps 13 between the undersides or lower flanges 14 of the channel sections 4 and the tops 11 of the cases 2.

Figure 4:
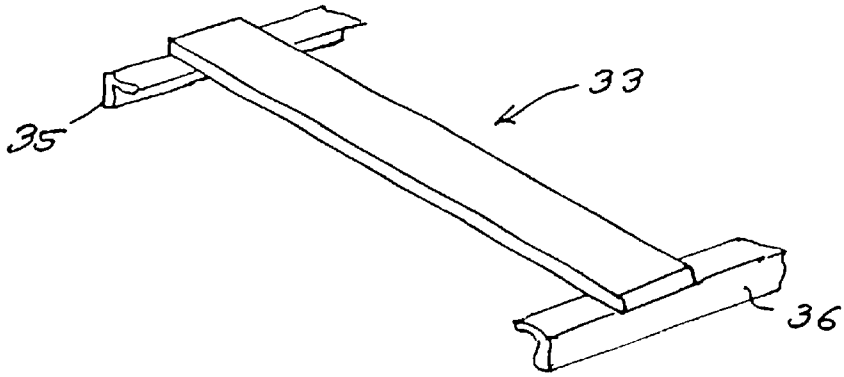
FIG. 4 shows in pictorial view a further embodiment of a prior art shelf, of lesser dimensions than the arrangements of FIGS. 1, 2 and 3.

FIG. 4 is a pictorial representation of an alternative form of shelf of the prior art, in which a product-carrying unit 33 which is relatively narrow in its direction of travel is again supported between laterally located support rails 35, 36 or the like on side walls (not shown) of a product treatment chamber. In this instance, a more dimensionally compact shelf structure 33 is provided by accommodating stiffening or rigidifying members within the floor configuration, for example in some kind of sandwich construction. Again however, a substantially impermeable floor arrangement is customary, so that in use of the shelf, a substantially continuous partition is again defined between successive airflow levels of the product treatment chamber, and again there is stratification of airflow, with airflow between successive levels being precluded. In these circumstances, substantially laminar airflow conditions are established within the product treatment chamber and there is an absence of turbulence such as would facilitate enhanced progression of heat exchange or freezing.

Figure 5:
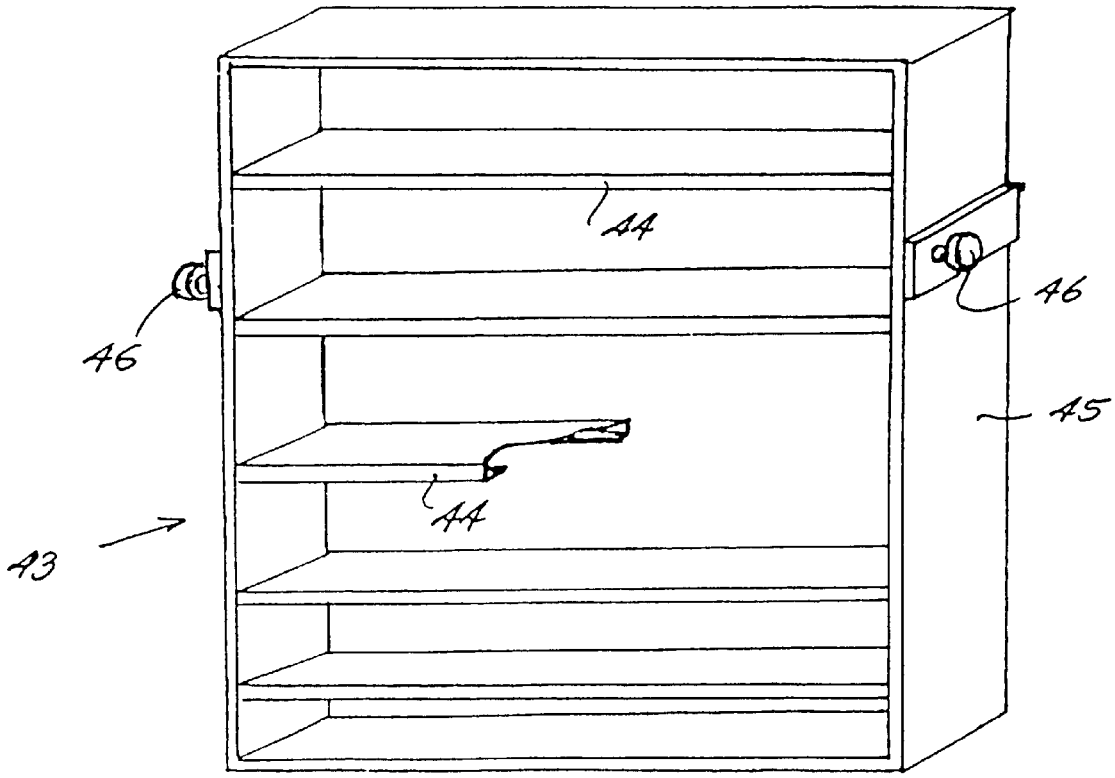
FIG. 5 is a diagrammatic pictorial illustration of a so-called "bookcase" shelf racking unit according to the prior art.

FIG. 5 is a pictorial representation of a so-called "bookcase" construction 43, in which a multiplicity of shelves 44 is housed within a rectangular outer wall structure 45 define a shelf racking unit, the outer wall structure being provided with support features or members 46 for cooperation with guide rails or like support arrangements extending along the inner sides of the side walls of a product treatment chamber. Essentially, the bookcase configuration 43 provides for a multi-shelf racking unit to be moved through the chamber as a single unit, but in the disposition of use of the product-carrying unit 43 within the chamber, the juxtaposed successive shelves 44 of a sequence of the racking units 43 again define substantially continuous partitions or floors within the chamber separating the airflow levels of the chamber from one another, thereby likewise inhibiting turbulent airflow and interchange of air movement between different levels, as in the case of the single shelf unit arrangements previously described. As shown in the part cut-away view of one of the shelves 44 of FIG. 5, a suitable cross-section for the shelf provides a downturned portion at each side of the planar shelf region, which is further reinforced by an inwardly directed flange on the lower edge of each downward portion.

Figure 6:
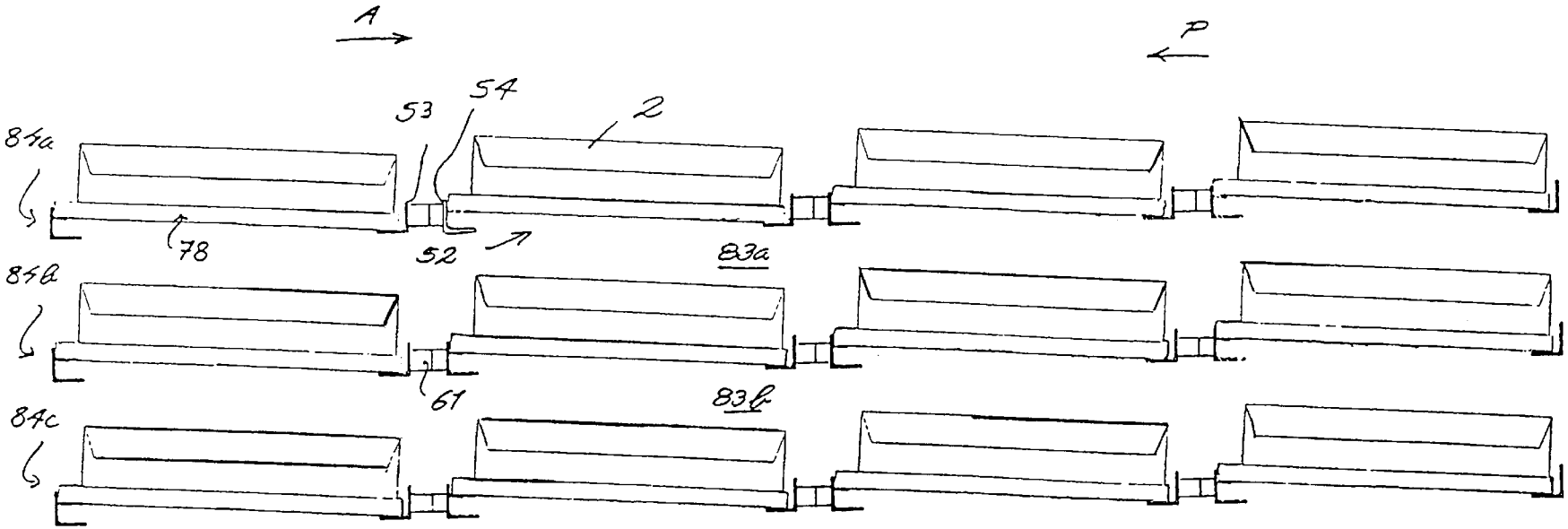
FIG. 6 is a end sectional view similar to that of FIG. 2 for a multiple case layout in a product treatment chamber accommodating product-carrying units according to the present invention.

The product-carrying unit 52 of the invention is shown in a multiple case layout similar to the prior art arrangement of FIG. 2, in the diagrammatic side sectional view of FIG. 6, which depicts a number of tiers or levels of support units 52 accommodated within a storage chamber or store. A principal feature of the invention is that the packages 2 are supported on the units 52 by way of a floor structure 78 which enables and facilitates a flow of cooling medium to come into contact with the undersides of the cases 2. In addition, the units 52 accommodated within the store are spaced apart in the longitudinal direction of unit movement by members 61, so that provision is made for air movement between different tiers or levels of inter-tier or between-level air passages 83*a*, 83*b* within the store by virtue of the adjacent edges of successive units 52 in each tier or level 84*a*, 84*b*, 84*c* of sequential units being spaced apart from one another to provide passages for air movement in a substantially vertical direction also. Thus in contrast to the prior art arrangement previously described, the opposed edges 53, 54 of adjacent product-carrying units 52 within the treatment chamber are not in direct abutment or juxtaposition. Provision for air contact with the undersides of the cases 2 is suitably achieved by a vented, ribbed or similar construction for the floor portion of the tray or shelf. A detailed embodiment is subsequently described.

Further advantageous aspects of the invention achieved in specific embodiments are that structural integrity is achieved without the necessity for underlying reinforcing members of large cross-section, and that the nominal carrying surface defined by the upper sides or faces of the supporting floor structure 78 is tilted, as shown in FIG. 6, preferably so that the nominal carrying surface rises in the direction of airflow through the store, thereby enhancing the impingement effect of cooling medium on the undersides of the cases 2 in the arrangement in which product travels through the store from right to left, as indicated by arrow P in FIG. 6, while airflow or the movement of cooling medium is directed through the store from left to right in FIG. 6, i.e. in the direction of arrow A. However, this direction of airflow represents only one option and the movement of heat exchange medium through the store may also take place in the opposite direction, i.e. in the same direction as that of product movement, without departing from the scope of the present invention. In a single direction treatment chamber, this preferred opposition of the direction of supporting unit travel to that of airflow may prevail, although, as noted above, the reverse direction of flow of heat exchange medium also comes within the scope of the present invention. A single-sided chamber arrangement may also be employed, in which product is both loaded to the chamber and removed from the chamber at one end, so that product and the supporting units may initially travel into the chamber also in the direction of arrow A, and then are reversed in their movement for removal following freezing or other treatment to return to the single loading and unloading point, at the lefthand end of the arrangement as shown in FIG. 6. Thus in one direction of product movement, the direction of flow of heat exchange medium relative to product is in this arrangement effectively reversed.

Figure 7:
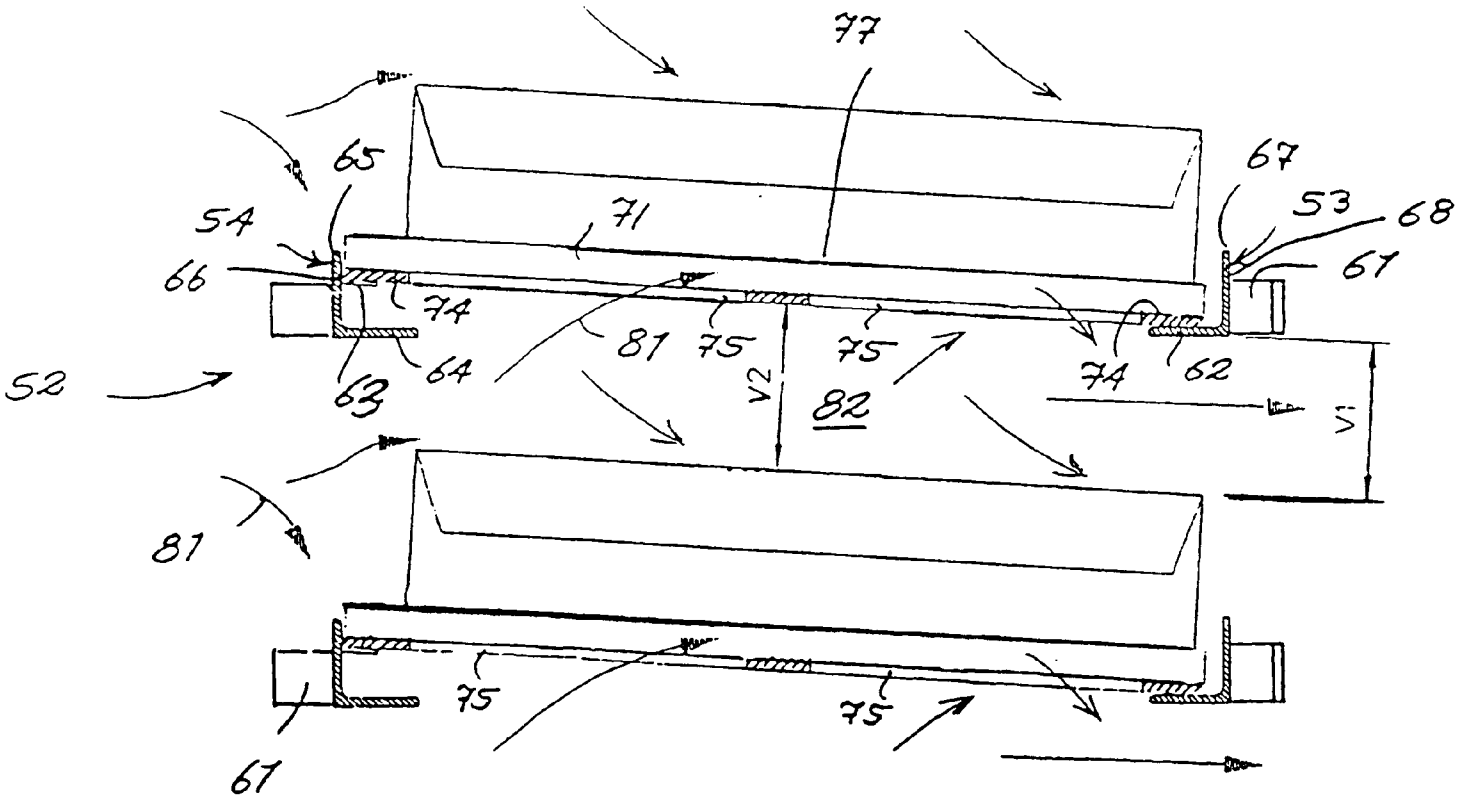
FIG. 7 is a view of two product-carrying units according to the invention, in cross-section, seen in the transverse direction of the product treatment chamber of FIG. 6, showing airflow detail for units according to the present invention, in a manner similar to that presented for the prior art arrangement of FIG. 3.

The cooling action of the airflow is enhanced by the tilt arrangement shown in greater detail in FIG. 7 in end sectional view across the transverse dimension of a treatment chamber. Tilt is provided by ribs 71 which define the product supporting surface or floor 78 (as subsequently described) sloping upwardly from one edge 53 of the support unit towards its other edge 54. At the edge 53 of the unit, the bases 74 of the ribs 71, which are suitably frustoconical in cross-section transverse to their longitudinal extent between edges 53 and 54, rest on and are secured to the upper surface of the horizontal flange portion 62 of an angle section transverse frame member 53, which flange portion is located towards the underside of the unit 52, while at the other transverse frame member 54, the bases 74 of the ribs 71 sit on and are fixed to a further flange portion 63 or other supporting arrangement provided within an angle section 54, flange 53 being located above the horizontal lower flange portion 64 of this angle section 54, but at a short spacing below the top edge 65 of the vertical angle section portion 66. In this way, a structure is provided in which the notional carrying surface defined by the upper surfaces 77 of the generally frustoconical rib sections 71 slopes downwardly from one edge 54 of the pallet or support unit 52 towards its other edge 53. The higher ends of the ribs 71 suitably define the unit edge region over which product loading and unloading is effected.

It will also be seen, in particular from FIG. 7 that the upper surfaces 77 of the frustoconical ribs 71 terminate slightly below the free upper edge or tip 67 of the vertical portion 68 of the low end angle section frame member 53, so as to provide a stop or abutment against which a case 2 supported on the pallet or support unit 52 may engage, to prevent it from forward sliding movement in a downward direction along the rib s 71. This arrangement is particularly advantageous to prevent displacement of cases 2 while they are being moved through a store. The upward tilt or inclination of the ribs 71 likewise inhibits any inadvertent movement of cases 2 supported on the unit 52 of the invention in the opposite direction, i.e. climbing movement along the ribs.

The airflow advantages accruing from the arrangement of the invention are demonstrated by the airflow arrows 81 of FIG. 7 for the exemplary arrangement in which airflow is from left to right in FIG. 7, but the advantages accruing to the invention are not limited to air movement in this direction, applying also in the case of airflow in the opposite direction, i.e. from right to left in FIG. 7. First of all, the structure of the support unit 52 of the invention is such that there is minimum obstruction across the transverse dimension of the treatment chamber or store to air movement in the longitudinal direction of the chamber. The support unit 52 of the invention is self-supporting by virtue of its own structure, in which the ribs 71 combine with the front 53 and rear 54 transverse angle section frame portions to provide a strong and deflection-resistant integral structure. The support units 52 of the invention are carried only at their side edges by means of the engagement of their sides with guide and support rails of the storage chamber. Thus there is minimal impediment to airflow and there is no significant change in the cross-section available for air flow between successive tiers or layers of product in the store from point to point along the air passage in the direction of air or product movement through the chamber, such as would engender stagnant areas with variation in air speed, as prevails in the prior art, see FIG. 3. This uniformity of tier to tier dimension exists because of the absence of airflow obstructing reinforcing cross members of large dimensions underlying and reinforcing the floor 71 of the unit 52, such as are present in the prior art arrangement of FIGS. 1 to 3. Thus air speed V1, V2 is substantially uniform throughout the spaces 82 between the tiers of cases 2 to be frozen by virtue of the substantially uniform and relatively unobstructed air flow passages resulting from use of the units of the invention in a product treatment chamber. A further and particular advantage pertaining from the open or ribbed structure of the support unit 52 is that flow of cooling air to the underside of the case 2 carried on the pallet 52 is facilitated. Such airflow can take place not only into ducts defined between the preferably upwardly tapering pyramidal or frustoconically shaped inclined ribs 71 at their higher ends in the vicinity of cross-member 54, through these ducts, and out in the vicinity of the front edge 53 of the unit 52, but ingress of air into such duct regions is also particularly effected through air spaces or vents 75 defined between the ribs 71 on the underside of the floor of the unit, as also is exit of air on the underside towards the front edge 53, again by way of further spaces or vents 75.

The combination of these features results in up to 95% of the surface of a case 2 containing foodstuffs supported on a product-carrying unit 52 according to the invention being exposed to airflow. Not only is therefore a greater package surface area exposed to airflow, but there is a significantly enhanced air impingement effect by the cooling air being conducted to the underside of the case 2. Since product within the case, which is to be chilled or frozen, is supported directly on the floor of the case, there is also no internal air space between case wall and product, such as may prevail under the top or cover of a case, so that in this way also, the cooling effect is enhanced. This is in contrast to the prior art, where cooling effect on the underside is minimal or non-existent. Furthermore, as already pointed out, airflow through the spaces 82 between successive tiers of cases 2 is substantially uniform, in other words V1, air speed at the gap extending between overlying unit edges, is substantially the same as V2, the air speed at the gap between the central region of a unit, midway between its edges, and an underlying case top, as compared with the prior art situation.

Figure 8:
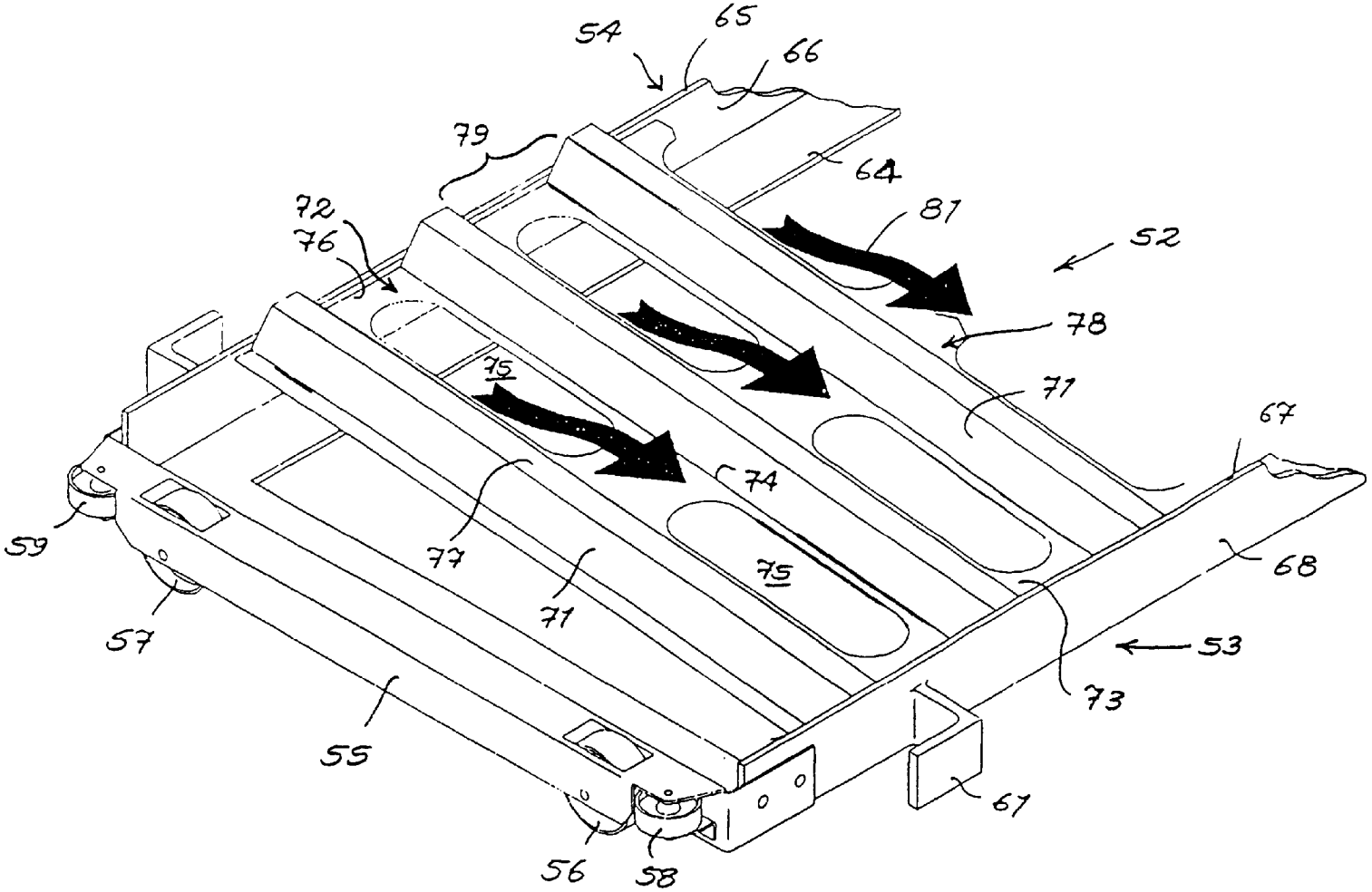
FIG. 8 is a fragmentary pictorial view showing one end of a referred embodiment of product-carrying unit in accordance with the invention.

Referring now to FIG. 8, there is shown a fragmentary pictorial view of one end of a shelf or product-carrying unit 52 according to the present invention, as embodied in a structure in general accordance with the arrangements of EP-B1-0,474,514. As previously emphasised however, the invention is not limited to product-carrying units of this kind.

The unit of FIG. 8 has a frame defined by transverse angle section members 53, 54 which extend across the width or transverse dimension of a product treatment chamber, in use of the product-carrying unit 52 for freezing action. These transverse angle section members 53, 54 are linked by side portions 55 of the frame, suitably also defining an angle section structure along the side edges of the unit 52. Within these side members or structure portions 55, there are housed near the ends of members 55 adjacent the cross-members 53, 54, respectively two support rollers 56, 57 mounted for rotation about horizontal axes, which sit on and are carried and supported by guide and support rails of the chamber in use of the product-carrying unit 52. These guide and support rails are mounted parallel to one another on the opposite inner faces of the side walls of a product treatment chamber. Further steering or guide rollers 58, 59 mounted for rotation about vertical axes are provided outward of the respective support rollers 56, 57, effectively at the corner edge of the support unit frame. Coupling members 61 on the transverse frame portions 53, 54 provide for interconnection of similar product-carrying units 52 and also for spacing apart of a sequence of units carried on a particular tier or pair of guide rails of the chamber, as already described, this facilitating vertical air movement within the chamber between inter-tier air passages.

In accordance with the invention, the product-carrying unit 52 is provided as an integral self-supporting and load-carrying structure in which a notional product-carrying surface on the upper side of the product-carrying unit 52 is defined by a multiplicity of rib members 71 extending in the front to rear direction of the product-carrying unit 52, i.e. between the respective 53 and 54 transverse angle section members defining edges of the unit. These bearers or ribs 71 are spaced apart so that spaces 79 are defined between them for the flow of air to the underside of a case containing foodstuffs supported on top of the ribs 71. As shown in FIG. 8, each rib 71 has an upper product-carrying surface 77, on which the underside of a case of product to be treated is supported in use of the unit. The spaced apart rib construction provided by the unit of the invention results in the portions of the product case between the regions supported on surfaces 77 of ribs 71 being available for impingement of cooling or other treatment-inducing air flow on the underside of the case. Thus the spaces 79 remaining between the floor region portions 77 provide access to the underside region of the product or product case disposed on the discontinuous upper product-supporting surface of the unit defined by the array of rib regions 77, for heat exchange contact between a heat exchange medium and the underside region of the product or case.

As shown in FIG. 8, a favoured structure according to the invention provides for the ribs 71 to be formed by upwardly tapering portions of frustoconical, i.e. truncated cone, cross-section, as seen in section in the edge-to-edge direction of the unit. Thus the transverse or width dimension of each rib 71 is less at its upper, package-supporting surface region, than its transverse dimension at the foot or base of the rib. Preferably, and again as shown in the drawing, these ribs 71 are formed by folding action from a single sheet of initially planar material, and the ribs are held at a uniform spacing by means of remaining portions 73 of the planar material, which link the lower side edges 74 of the frustoconical rib sections. This structure thus provides that effectively a duct 72 is defined in the regions between the spaced apart ribs 71, the duct 72 underlying the lower surfaces of product cases supported on the upper surfaces 77 of the ribs 71, so that in use of the unit, with product supported on the ribs 71, the invention provides for heat exchange air flow through the duct 72 defined between the sidewall regions of adjacent spaced apart ribs 71, the underside of the case supported on the ribs or unit floor 77, and the panel portions 73 interconnecting the ribs. Thus it is provided according to the invention that the floor region 78 of the product-carrying unit is shaped to define duct means 72 for directing the flow of heat exchange medium towards the spaces 79 between the floor portions 77, i.e. between the upper surfaces of the ribs 71 in the direction across the unit 52 between its side portions or members 55, so that heat exchange contact may take place between the heat exchange medium and the underside of product supported on the ribs 71 by means of impingement of the heat exchange medium against the underside surfaces of the product or case occluding these spaces 79 between the floor region portions 77.

In order to provide for enhanced airflow to the underside of a case supported on the ribs 71, elongate apertures, spaces or vents 75, with a longitudinal dimension in the same direction as that of the ribs 71, are suitably punched out from the remaining planar material portions 73 between the ribs 71. The punching is preferably carried out in a downward direction to avoid any burr or cutting edge remaining on the case-supporting side of the panel regions 73. Two such apertures or vents 75 are shown in FIG. 8, one extending from the vicinity of edge region 54 towards the centre region of the unit, and the second running from near the centre of the unit to the vicinity of edge region 53. These apertures 75 provide for enhancement of airflow to the underside of a case supported on the ribbed support unit structure, upwardly through these openings 75 into the air ducts 72 from beneath the unit 52, as indicated by airflow arrow 81 for air movement from the lefthand side in FIG. 8, in particular through vent 75 extending from edge 54, and also downwardly again, to exit duct 72 near the edge region 53, through at least the portion of second 10 aperture 75 located in the vicinity of this edge 53. There is thus engendered enhanced heat exchange with the underside of a package or case supported on the unit as well as turbulence in the airflow within ducts 72. It will be appreciated that a reverse pattern of airflow will apply in the event of right to left air movement being applied to a unit in the FIG. 8 orientation. Thus the apertures 75 provide for further ingress of cooling medium to the ducts 72 defined between the ribs 71, the underside of cases supported on the unit and the panel portions 73, and likewise for exit of cooling medium from this region, following heat exchange action.

It will also be appreciated that the bearers or ribs 71 may alternatively be defined by individual rib portions or slats, extending between the transverse edge frame members 53 and 54 of the support unit 52. Such independent ribs or slats may be welded or otherwise secured to the transverse frame members of the unit, to provide a structure in accordance with the invention. It is not necessary for the ribs or slats to be formed by folding action from a single initially planar sheet of material. However, the favoured structure formed by such folding action provides in convenient manner a lightweight structure of significant strength in which the ribs are uniformly spaced from one another by virtue of the remaining intervening portions of planar material. The folded structure thus formed is particularly amenable to incorporation in the frame structure of the product-carrying unit, while also aperturing of the remaining floor portions of the folded rib structure provides in advantageous manner for enhanced air access to the underside of packages supported on the ribs. The described structure represents therefore a particularly favoured embodiment.

Figure 9:
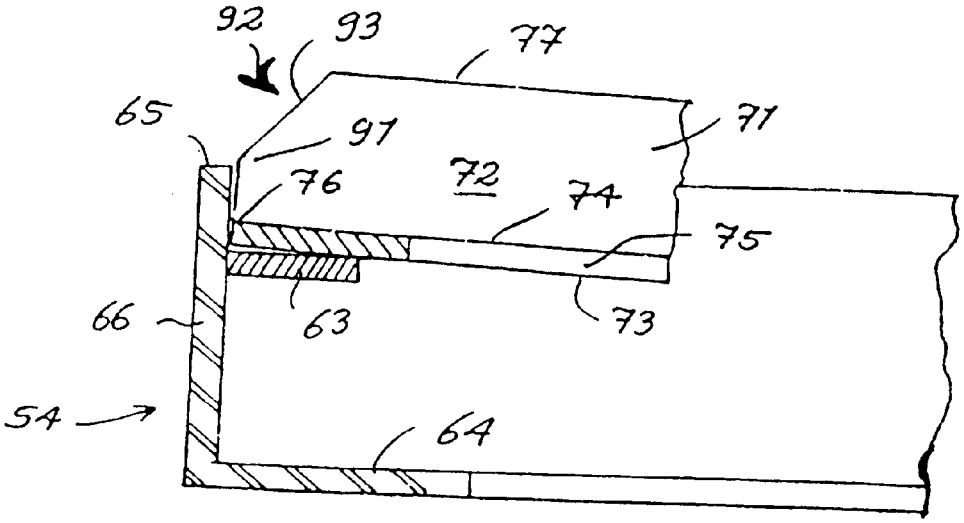
FIG. 9 is an enlarged sectional view of the upper end region of one of the tilted ribs of the product-carrying unit of FIG. 8.

The structure of the preferred support unit according to the invention ensures that there is no significant obstruction to airflow. This favoured structure is achieved not only by the general features of the design already outlined, together with choice of a material of suitable rigidity and structural strength for the ribs, but also by providing appropriate stiffness in the structure wherever possible, for example by the provision of a crimped arrangement 91, as shown in the detail view of FIG. 9, at the upper ends of the tilted or sloping ribs 71. This crimping of the end of the rib 71 provides a downward deformation of the rib end region 92 to provide a short ramp 93 leading upwards from the top edge 65 of the vertical arm 66 of the angle section transverse frame member 53 to the nominal product-supporting surface defined by the top portions or surface regions 77 of the ribs 71. The short ramp thus defined, in addition to engendering stiffness of the structure, enables easy sliding-on of cartons 2 onto the carrying surface defined by the pallet or support unit 52 as a whole. The sloping surface 92 running up from the top edge 65 of the rear end cross member 53 defines this ramp 93.

Figure 10:
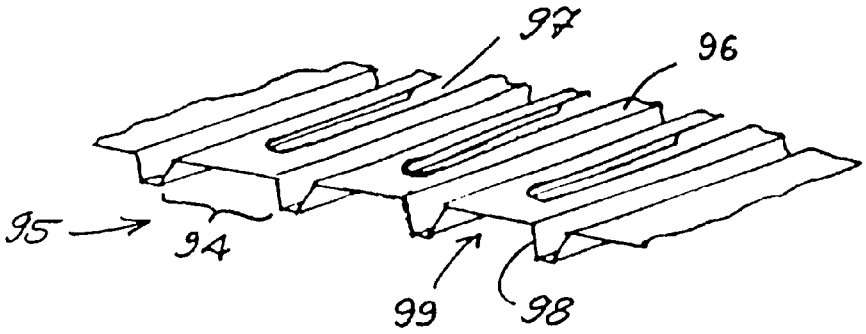
FIG. 10 shows an alternative floor arrangement for a product-carrying unit in accordance with FIGS. 8 and 9.

An inverted floor arrangement is also possible, as shown in FIG. 10, in which the same folded floor structure 95 as provided in FIG. 8 is deployed, but is inverted as compared with the FIG. 8 arrangement, so that the floor area portions 96, apertured 97 as required by the invention, are in contact with the undersides of the cases, and ribs 98 are directed downwardly. Ducts 99 are again defined between the ribs 98, and access to the ducts from beneath is effected through the spaces 94 extending between the downwardly directed tips of the frustoconical section ribs 98, while heat exchange communication with the undersides of cases supported on the floor 95 takes place in this arrangement through the punched apertures 97 in the planar floor regions 96 linking the ribs 98, the direction of punching being again selected to avoid any upstanding burr or projection directed towards the upper product-carrying surface.

In the preferred structure of the invention, in which the support unit is in accordance with the principles of EP-B1-0,474,514, the module size is typically 610 mm (2 feet) front to rear and 3353 mm (11 feet) transverse. Prior art structures, such as those shown in FIGS. 2 and 3, typically use a larger size shelf or board, for example 1219 mm (4 feet) front to rear, 6706 mm (22 feet) across. However, the structure of the present invention providing for improved cooling of the underside of foodstuffs cases may also be applied to such prior art structures, in particular in combination with the especially favoured tilt feature shown in FIGS. 6 to 9.

As further previously noted, this tilt or inclination or angling of the carrying or support surface also ensures that a product supported on the pallet is blocked at one end or edge of the unit against movement relative to the unit or pallet. The structure illustrated and described provides a stop member across the width of the pallet at the lower end of the supporting region or surface. Product cannot slide from the pallet because of this stop and is also protected from sliding in the opposite direction by the upward tilt. Thus any possible movement of product relative to the pallet against the slope of the ribs is opposed by the action of gravity. Movement in one direction is physically blocked or impeded, and movement in the other direction is inhibited by the inclination, tilt or slope of the rib and gravitational action.

The product-carrying unit of the invention provides much greater turbulence within a product treatment chamber or store than prior art arrangements. Not only does air travel above and below the pallets, but it can also travel upwardly and downwardly within the store or chamber through the gaps between the pallets when the pallets are spaced apart by being supported on the rails and coupled to one another as in the case of the preferred embodiment of FIGS. 6 to 9, in which air gaps remain between the juxtaposed edges of a sequence of pallets on a particular level or tier for passage of air or heat exchange medium between an air flow region above the tier and an air flow region below the tier. In the case of the prior art arrangement shown in FIG. 3, it will be seen that the shelves effectively separate the store into a series of tiers or levels, with airflow taking place at each tier or level from one end of the store to the other. There is no facility for transfer of airflow between levels intermediate the ends of the store.

The invention is especially directed to the achievement of faster cooling or freezing. This is achieved also with more even or uniform cooling of individual containers. The system of the invention provides substantially optimised treatment, in which each container is given an individual treatment which is uniform at substantially all locations within the store, rather than all of the containers within a store receiving treatment, the quality of which varies depending on the location of the container within the store. The present invention approaches the ideal situation of the total case surface being exposed to airflow, such as could be established if the case were suspended in mid-air without its being in physical contact with any surface.

A further advantage is that containers or cases for freezing in a system according to the invention and using product-carrying units according to the invention may also be dried. Drying is particularly relevant to any application where product and/or box may be moist or wet, for example, in the case of a leaking product. Use of the product-carrying unit of the invention in a system according to the invention enables boxes containing wet product to be dried off, before product and box are frozen.

Product boxes in such stores are handled mechanically, with one or two boxes per product-carrying module, depending on the size of the module.

A diversity of advantages are achievable by the invention. These may be summarised as follows:

1. In the case of freezing, the time required to reach a particular temperature may be significantly reduced.
2. Alternatively, to reach the same freezing temperature, the same time as customary in prior art freezers may be used, but because of the improved efficiency of the system, this temperature is achievable within the specified time by a higher cooling air temperature than the prior art. Thus the horsepower requirement of the system compressors is reduced.

Advantages 1 and 2 are effectively alternatives, and one or other may be selected. Alternatively, a combination of both may be applied, in a substantially optimised arrangement. Efficiency gains of the order of 12 to 15% are believed to be achieved by the first-mentioned advantage, while the gain may be in excess of 15% for the second-mentioned advantage, because the freezing effect is not linear.

The system also has the following third advantage, which is present irrespective of which of the alternative advantages 1 or 2 is selected.

3. A reduced airflow pressure drop is experienced in a system incorporating product-carrying units of the invention. This reduced pressure drop, which may be of the order of 20% as compared with the prior art systems, reduces the load on the fans and also reduces heat dissipation through the motors. Overall gain in efficiency, combining advantages 1 or 2 and 3, may therefore be 15 to 20%, as compared with prior art systems. Thus this efficiency may be embodied by faster freezing, using the same power as in a conventional store, or alternatively, significantly less power may be applied in achieving the same freezing effect as in a prior art store, over a similar time period, since the lower the freezing temperature to be achieved, the greater the power required in the system. In all instances, the foregoing gains are also combined with a reduced pressure drop through the system, with the consequent reduction in fan horsepower and heat dissipation.

Thus in summary, the new pallet shelf of the invention allows freezing to be effected at least 12 to 15% faster than prior art arrangements or with achievement of a comparable advantage. Boxed product is angled towards or against the direction of airflow, air speed for a mechanical air freezer being typically 800 to 1200 feet per minute. The arrangement of the invention also obviates any laminar flow situations such as tend to be established in the prior art arrangements, by virtue of turbulence being created according to the invention by tilting the shelf and the box, but stagnation of flow is in addition minimised by virtue of the air flow passages being as far as possible of substantially uniform cross-sectional dimension transverse to the air flow direction throughout the extent of the treatment chamber in the direction of air flow. The provision of venting such as by way of slotted holes in the underside of the structure or shelf allows high velocity air to impact directly onto the lower side of boxed product, thus improving heat transfer. Prior art systems do not allow the achievement of such a facility. Thus all surfaces of the box are exposed to high velocity air, with only a minimum barrier remaining between box and airflow. The arrangements mimic therefore to the greatest possible extent the ideal scenario of a box hanging in the airflow. Exposing the underside of the box to airflow ensures that portion of the box with which the majority of the product is in contact, which is typically occluded in prior art situations, is exposed to airflow. Furthermore, any dampness at the bottom of the box is dried up because of contact with the airflow, while excess water from the box may be drained away through the open undersurface of the shelf. Finally, spacing apart of product-carrying units within each level of a store facilitates further improved heat exchange by allowing vertical movement or transfer of cooling medium from level to level within a treatment chamber at locations other than the chamber ends.

The words "comprises/comprising" and the word "having" when used herein with reference to the present invention are used to specify the presence of stated features, integers, steps or components but do not preclude the presence or addition of one or more other features, integers, steps, components or groups thereof.

What is claimed is:

1. A product-carrying unit (52) for use in a product treatment chamber (1), the unit (52) having:

side portions (55) extending along two opposite side regions of the unit for engagement (56, 57, 58, 59) with respective support features (15, 16) of a product treatment chamber (1), and a floor region (78; 95) for the support of product (2), said floor region (78; 95) extending between said side portions (55) and comprising a multiplicity of floor region portions (77; 96) together defining a discontinuous upper product-supporting surface of the unit (52), wherein spaces (79; 97) defined between at least some of said multiplicity of floor region portions (77; 96) provide access to an underside region of product (2) disposed on said discontinuous upper product-supporting surface of the unit (52) for heat exchange contact between a heat exchange medium and said underside region, characterized in that the unit (52) further comprises duct regions (72; 99) defined substantially between a region in the vicinity of one edge portion (76) of the unit (52) extending between said side portions (55) of the unit and a region in the vicinity of another edge portion (68) of the unit also extending between said side portions (55), said duct regions (72; 99) underlying the underside region of product (2) disposed on said discontinuous upper product-supporting surface of the unit (52), and said spaces (79; 97) communicating between said duct regions (72; 99) and said upper product supporting surface of the unit (52).

2. A unit according to claim 1, wherein access (75; 94) to said duct regions (72; 99) for at least ingress of heat exchange medium is provided on the lower side of the unit (52) intermediate said edge portions (76, 68) of the unit.

3. A unit according to claim 1, wherein said floor region comprises a multiplicity of rib members (71) extending between said edge portions (76, 68) in a direction substantially parallel to said side portions (55), upper surface regions (77) of said rib members (71) defining said discontinuous upper product-supporting surface of the unit (52), and said duct regions (72) being defined between said rib members (71).

4. A unit according to claim 3, wherein said rib members (71) slope downwardly from one (76) of said edge portions (76, 68) of the unit (52) towards the other (68) of said edge portions (76; 68) of the unit (52).

5. A unit according to claim 4, wherein a stop feature for restraint of product (2) supported on the unit (52) is provided at said other (68) of the edge portions (76, 68) of the unit (52).

6. A unit according to claim 4, wherein said rib members (71) terminate at said one (76) of the edge portions (76, 68) of the unit (52) at a level above that of the upper edge (65) of a cross-member (66) defining said one (76) of the edge portions (76, 68), and the upper surfaces (77) of said rib members (71) are sloped downwardly (92) in the vicinity of said one (76) of the edge portions (76, 68) to define a ramp portion (93) extending between said upper edge (65) of said cross-member (66) and the level of said discontinuous upper product-supporting surface of the unit (52).

7. A unit according to claim 3, wherein said rib members (71) are substantially frustoconical in cross-section in the direction extending between said edge portions (76; 68) of the unit (52).

8. A unit according to claim 3 to, wherein said rib members (71) are defined by upstanding folded regions of an initially planar material portion and the rib members (71) are substantially uniformly spaced from one another by remaining intervening planar sections (73) of said initially planar material.

9. A unit according to claim 8, wherein access to said duct regions (72) for at least ingress of heat exchange medium is provided by apertures (75) in said remaining intervening planar sections (73) of said initially planar material.

* * * * *